United States Patent [19]

Hagimoto et al.

[11] Patent Number: 5,032,039

[45] Date of Patent: Jul. 16, 1991

[54] UNDERGROUND EXCAVATOR

[75] Inventors: Hakumi Hagimoto; Yutaka Kashima; Norio Kondo; Tsutomu Tomisawa; Kiichi Honma, all of Tokyo, Japan

[73] Assignee: Daiho Construction Co., Ltd., Tokyo, Japan

[21] Appl. No.: 609,173

[22] Filed: Nov. 5, 1990

Related U.S. Application Data

[63] Continuation of Ser. No. 367,430, Jun. 16, 1989, abandoned.

[51] Int. Cl.[5] ..... E21D 9/06

[52] U.S. Cl. ..... 405/141; 405/138; 175/189; 299/55; 299/62

[58] Field of Search ..... 405/138, 141, 142, 143; 299/55, 58, 62; 175/189

[56] References Cited

U.S. PATENT DOCUMENTS

| | | | |
|---|---|---|---|
| 3,235,014 | 2/1966 | Brooks | 175/189 X |
| 4,165,129 | 8/1979 | Sugimoto et al. | 405/141 X |
| 4,167,289 | 9/1979 | Ono et al. | 405/141 X |
| 4,624,605 | 11/1986 | Akesaka | 405/141 X |
| 4,674,913 | 6/1987 | Matsuda | 405/141 X |

FOREIGN PATENT DOCUMENTS

| | | | |
|---|---|---|---|
| 3623553 | 1/1988 | Fed. Rep. of Germany | 405/141 |
| 39359 | 8/1982 | Japan . | |
| 30118 | 7/1986 | Japan . | |
| 1364684 | 1/1988 | U.S.S.R. | 405/141 |

*Primary Examiner*—Dennis L. Taylor
*Assistant Examiner*—John Ricci
*Attorney, Agent, or Firm*—Lynn & Lynn

[57] ABSTRACT

An underground excavator includes a chamber defined in the forward section of an excavator body for receiving excavated material such as soil, sand, gravel, clay and their mixtures. A rotary cutter is mounted to the forward end of a rotary shaft for penetrating through the chamber for axial rotation and simultaneous rocking in an axial direction. The cutter has a conical cutter face plate having holes for passing the excavated material of a diameter smaller than an opening disposed in the chamber. Any gravel or the like present in the advancing route to the underground excavator and smaller than the holes of the cutter is received into the chamber to be discharged from the excavator. Any gravel larger than the holes or the like not receivable into the chamber is moved quickly along the conical cutter face plate toward peripheral ground layer by being subjected to the rocking motion of the conical cutter face plate simultaneously with the rotation of the cutter during advancement of the excavator. Facilities and labor formerly required for removing larger gravel or like materials can be omitted to remarkably reduce excavation costs.

4 Claims, 2 Drawing Sheets

UNDERGROUND EXCAVATOR

This is a continuation of copending application Ser. No. 367,430 filed on June 16, 1989, now abandoned.

BACKGROUND OF THE INVENTION

This invention relates to an underground excavator having a chamber defined in the forward section and a rotary cutter mounted to the forward end of a rotary shaft positioned to penetrate through the chamber, such that excavated materials such as soil, sand, gravel, clay and their mixture are excavated by the cutter penetrating the chamber.

The underground excavator of the kind referred to is to be placed in a vertical shaft bored in the ground and driven horizontally from the shaft into the ground to excavate the same. The excavator is effective for the installation of pipes, for example, with Hume concrete pipes or the like, for boring a tunnel through the ground composed of a high gravel content.

One method for installing pipes underground includes boring a vertical shaft into the ground to a desired depth for embedding the pipes. A leader pipe is driven through the vertical shaft horizontally into the ground. Other pipes are then pushed through the leader pipe. However, driving the leader pipe from the rearward end becomes impossible when the resisting force of the ground is large; or, if the gravel content is high, the gravel accumulating at forward end of the leader pipe hinders the leader pipe and following pipes from advancing or at least causes them to deviate from the intended route.

Japanese Patent Publication No. 57-39359 of M. Mituwa, suggests an underground excavator which uses an excavating cutter instead of the foregoing leader pipe to excavate the ground and to crush the gravel. More specifically, this excavator includes a chamber defined in the forward section for receiving therein the materials excavated. A rotary shaft and an excavating cutter, having tunnel-face ground cutting and gravel crushing bits at the forward end, are positioned to penetrate through this chamber. This underground excavator is more effective through ground having a large resisting force or high in gravel content than the conventional apparatus employing only the leader pipe, because removing hindering ground matter improves excavating ability and velocity. However, there still have been problems in that concurrently providing the gravel crushing bits and the ground cutting bits is expensive. Also, when the ground is a mixture of relatively soft ground stuffs with a high gravel content, excavation is almost impossible. This is because the low holding force of the ground for the respective gravel pieces yields only a small stress in the gravel pieces even when hit by the gravel crushing bits so that the gravel stays in the advancing route of the excavator.

Japanese Patent Publication No. 61-30118 of M. Araki suggests another underground excavator having a crushing chamber defined in the forward section of the excavator. A plurality of roller bits of generally conical-shape for crushing larger gravel, a rotary shaft to penetrate through the chamber, a spoke-shaped excavating cutter mounted to the forward end of the shaft; and excavating bits are disposed therein. This excavator crushes the gravel between the larger-gravel crushing roller bits formed on the rearward face of the cutter and the inner peripheral crushing wall of the crushing chamber to prevent the larger gravel, in particular, from accumulating in the advancing route of the excavator. This excavating function is an improvement over the subject excavator of the foregoing Publication No. 57-39359. However, using the larger gravel crushing arrangement and coupling the rotary shaft to a high output driving power source in order to crush ground of a variety of hardnesses and sizes complicates the apparatus and increases manufacturing costs. Further, the larger-gravel crushing bits are rapidly worn out due to repeated contact with the gravel for its crushing, and there has been a problem in the durability.

SUMMARY OF THE INVENTION

A primary object of the present invention is, therefore, to provide an economical underground excavator to be used in pipe installation, tunnel boring, and the like, particularly when excavating through ground having larger gravel therein.

According to the present invention, the above object can be attained by an underground excavator in which a chamber with a bulkhead for receiving excavated material is defined in the forward section of a cylindrical body. A rotary shaft passed rotatably through the bulkhead is projected into the chamber. A driving power source for the rotary shaft is disposed behind the bulkhead. An excavating cutter is mounted to the forward end of the rotary shaft, and means having an opening in the chamber is provided for discharging the excavated stuffs. The excavating cutter comprises a cutter face plate provided with a plurality of cutter bits and a plurality of holes for passing the excavated material therethrough, with the rotary shaft positioned to be shiftable in its axial direction with the excavating cutter mounted thereto. The cutter face plate of the cutter is preferably formed in a conical shape, and the opening of the discharging means is preferably formed of a diameter larger than the holes in the cutter face plate.

According to the underground excavator of the foregoing arrangement, as the excavator advances, the conical surface of the cutter face plate causes any gravel to gradually shift along the conical surface radially outward while being subjected to forward and rearward rocking motion of the excavating cutter. Integral with the rotary shaft axially shifting forward and rearward, the gravel in front of the cutter face plate is moved to a position where it will not hinder the advancement of the excavator and is replaced by other excavated material in the ground adjacent the excavator. The holes made in the cutter face plate are preferably smaller than the opening of the discharging means provided to follow the chamber so that they are effective to cause the gravel exceeding the gravel size practically capable of being discharged through the discharging means not to be received in the chamber but to be eventually embedded into the ground around the excavator.

Other objects and advantages of the present invention shall be made clear in the following explanation of the invention detailed with reference to preferred embodiments thereof shown in accompanying drawings.

DESCRIPTION OF PREFERRED EMBODIMENTS

While the present invention shall now be explained with reference to the embodiments shown in the accompanying drawings, it should be appreciated that the intention is not to limit the invention only to such embodiments but rather to include all alternations, modifications and equivalent arrangements possible with the scope of appended claims.

Figure 1:
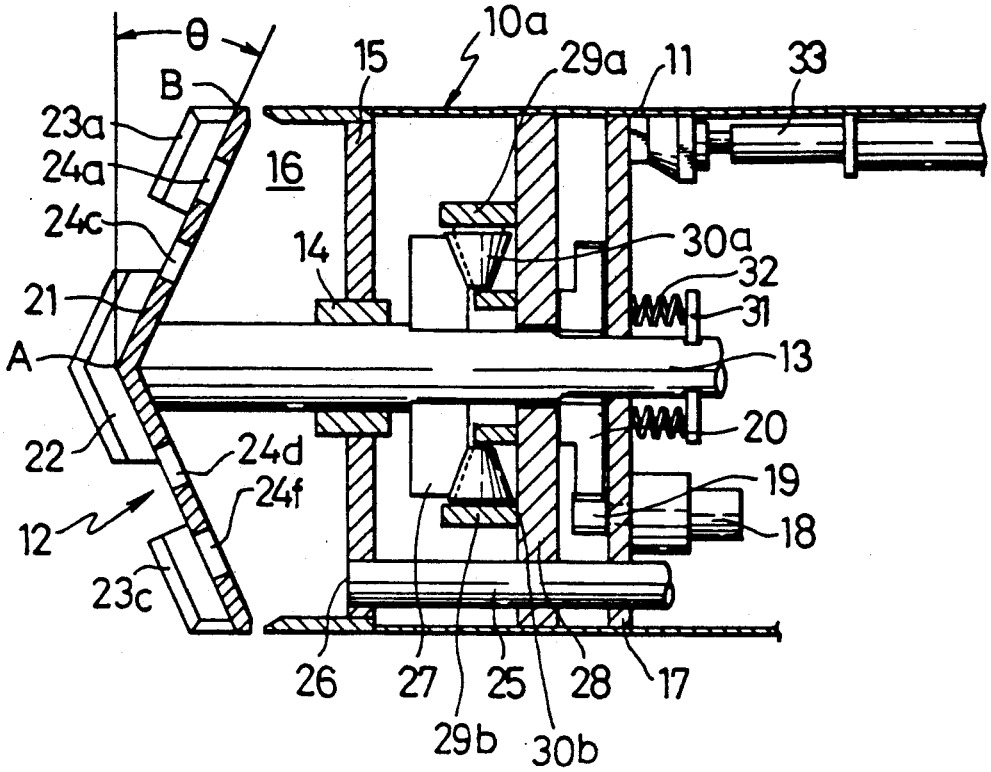
FIG. 1 is a schematic sectioned view in an embodiment of the underground excavator according to the present invention.
Figure 2:
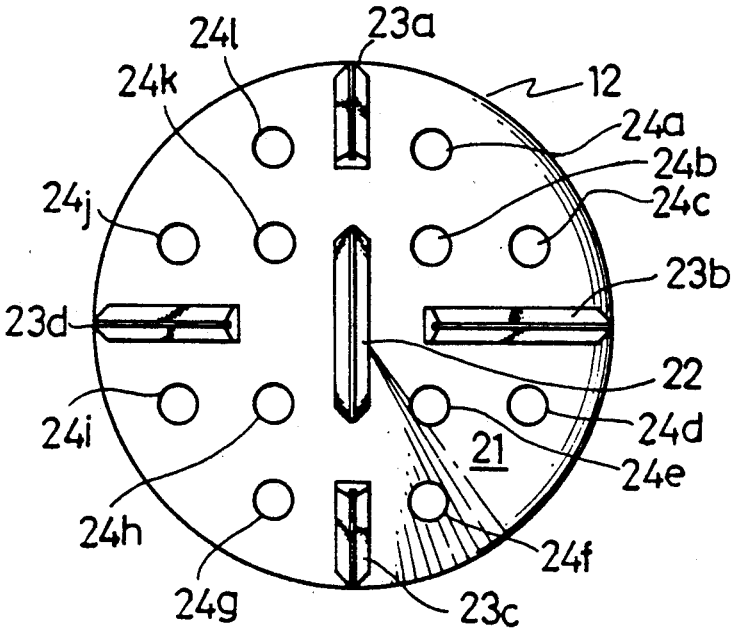
FIG. 2 is a front view of the excavating cutter in the excavator of FIG. 1.

Referring here to FIGS. 1 and 2, there is shown an underground excavator employable in installing underground pipes such as Hume concrete pipes. For the pipe installation, the excavator is made to be of an outer diameter of 20 to 40 cm, but the diameter may properly be varied in accordance with required diameter of the pipes to be installed. The present invention is also applicable to boring tunnels by means of, for example, a shield type tunnel boring system, in which the excavator may be of any outer diameter adapted to the required tunnel diameter, for example, several meters.

More specifically, the underground excavator 10 generally comprises a cylindrical body 11 and an excavating cutter 12 provided to forward end part of the body 11. The excavating cutter 12 is mounted to a forward end of a rotary shaft 13 to be rotated therewith. The rotary shaft 13 is positioned on the axis of the body 11 and supported through a shaft bearing 14 by a bulkhead 15 in an axially rotatable and shiftable manner. A chamber 16 into which excavated material is led is defined between the excavating cutter 12 and the bulkhead 15. A fixing plate 17 in the cylindrical body 11 is provided at a rearward position from the bulkhead 15. A reversible motor 18 having an output pinion 19 is secured to the fixing plate 17. A driving gear 20 mounted about the rotary shaft 13 meshes with the pinion 19. In this case, the driving gear 20 is spline-coupled to the rotary shaft 13 so that while an output rotary force of the motor 18 is transmitted through the gear 20 to the shaft 13, the gear 20 will be relatively shiftable in the axial direction of the shaft 13.

The excavating cutter 12 comprises a substantially conical surface cutter face plate 21. The cutter face plate 21 is provided with a central cutter bit 22 positioned forward in the center of the plate corresponding to the forward tip end of the rotary shaft 13. A plurality of peripheral cutter bits **23*a*–23*d* extend radially inward from the outermost periphery of the plate 21 and project outward in forward direction. A plurality of passages 24*a*–24*i* are made in the conical surface of the cutter face plate 21 between the respective peripheral cutter bits 23*a*–23*d*. The conical angle of the cutter face plate 21, that is, an angle $\theta$ defined by a line connecting between the top point A and a peripheral point B with respect to a line intersecting the axial line of the shaft 13** at a right angle should properly be selected to be one of various angles up to 45 degrees on the basis of such conditions as geologic nature of the ground through which the pipe way or tunnel is to be made.

Discharge means 25 such as a screw conveyor or the like is provided in a lower portion of the cylindrical body 11. A forward end opening 26 is positioned as an inlet port of the discharge means 25 at a lower portion in the chamber 16. A substantial body of the discharge means 25 extends rearward beyond the bulkhead 15 and fixing plate 17 so that the material excavated and led into the chamber 16 enters the opening 26 and exits rearward of the bulkhead 15 and fixing plate 17. Hydraulic discharge systems and pressurized mud systems may be used to deal with the excavated material. When a hydraulic discharge system is employed, a pressurized slurry feed pipe (not shown) may be passed through the axis of the rotary shaft 13 and the bulkhead to continuously supply a pressurized slurry into the chamber 16 for providing a slurry pressure capable of resisting the ground pressure at the tunnel face being excavated. The excavated material taken into the chamber 16 is discharged through the discharge means 25 as carried by the slurry supplied into the opening 26. If required, an additive solvent, viscosity-providing agent or the like may be added to the slurry. As will be readily appreciated, a mixture of the discharged slurry and the excavated material is led, for example, to a slurry setting vessel installed on the ground surface (not shown) for recirculating use.

When the pressurized mud system is utilized, a setting agent for highly fluid mud is fed into the chamber 16 through a pipe provided to pass through the axis of the rotary shaft 13 as is khown in the art. A pressurized and rather viscous mud forms continously in the chamber 16 to resist the tunnel face ground pressure. Such pressurized mud is sequentially discharged by suitable discharge means as a screw conveyor to the exterior, keeping the state of the pressurized mud.

Further, a cam 27 is secured to the rotary shaft 13 to be positioned behind the bulkhead 15 and brought into rolling contact with rollers **30*a*–30*b*, which follow the cam 27. Rollers 30*a*–30*b* are borne by hearings 29*a*–29*b* integrally provided on a support plate 28 secured in the body 11 between the bulkhead 15 and the fixing plate 17. The cam 27 is formed so that as the rollers 30*a*–30*b* roll on the wavy cam surface, the rotary shaft 13 carrying the cam 27 will shift forward and rearward in the axial direction. To provide the axial shifting of the rotary shaft 13, the cam 27 preferably has a wavy surface with projecting ridges alternating with depressions. The rotary shaft 13 carries at its rearward end terminating behind the fixing plate 17 a support disk 31. This support disk 31 does not follow the rotation of the shaft 13, but shifts forward and rearward. A resetting spring 32 is disposed between the fixing plate 17 and the support disk 31 so as to be compressed by the forward shift of the shaft 13 under the rolling contact of the rollers 30*a*–30*b* with the rotating wavy cam surface of the cam 27 and, thereafter, to resiliently reset the shaft 13 rearward. Further, the cylindrical body 11 is to be propelled in a manner known in the art by means of propelling jacks 33 (only one is shown) disposed to engage the rear portion of the body 11** as mutually spaced circumferentially, or by a separate propelling means (not shown) provided to push the rearward end of the pipe way installed behind the excavator.

Referring next to the operation of the underground excavator according to the present invention, the rotation of the reversible motor 18 in either direction causes, through the output pinion 19 and driving gear 20, the rotary shaft 13 in the spline-coupling with the gear 20 to be rotated to eventually rotate the excavating cutter 12. The tunnel face ground is thereby excavated. During excavation the cam 27 and the spring 32 cause alternating forward shifting and rearward resetting of the shaft 13 and cutter 12. Thus the rotary shaft 13 simultaneously performs rotations about the axial line and shifts along the axial line. In this case, the forward and rearward shift of the rotary shaft 13 should preferably be set so that the maximum clearance between the forward end edge of the body 11 and the outer peripheral edge of the cutter face plate 21 (see FIG. 1) willl effectively prevent any relatively large or enlongated gravel from entering into the chamber 16.

The material excavated at the tunnel face enters the chamber 16 mostly through the passages 24*a*–24*i*, and are conveyed through the opening 26 to the rearward position of the body 11 by the discharge means 25. The passages 24*a*–24*i* have smaller diameters than the opening 26 of the discharge means 25, so that any gravel of a dimension larger than the opening 26 can never be present in the chamber 16.

Now, in an event where the gravel mixture includes larger gravel in the tunnel face ground, the larger gravel is not allowed to pass through the holes 24. The larger gravel is pushed by the conical cutter face plate 21. The rocking motion due to the axial forward and rearward shift during the rotation of the cutter 12 shifts the gravel radially outward as the excavator advances, causing the larger gravel to be gradually embedded into the surrounding ground and replaced by other material in the earth around the body 11.

The propelling jacks 33 are driven in conformity to the excavation of the ground to propel the body 11 forward. The pipes are sequentially installed or, in the case of the tunnel boring, the peripheral wall surface of the tunnel newly appearing behind the body 11 propelled is retained, if necessary; and the tunnel boring can be smoothly realized.

Figure 5:
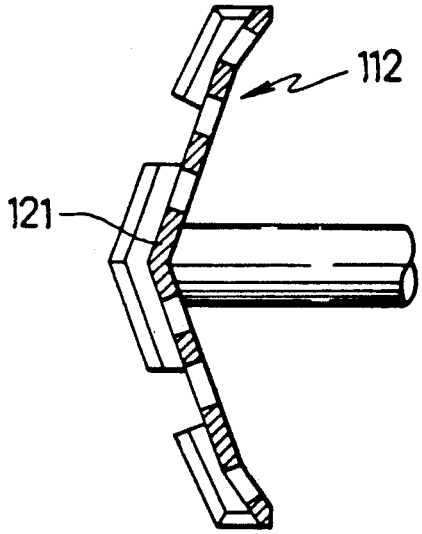
FIGS. 5 and 6 are fragmentary sectioned views showing other embodiments of the excavating cutter in the present invention.
Figure 3:
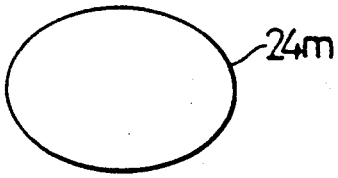
FIGS. 3 and 4 are explanatory views for different aspects of the passages made in the excavating cutter employed in the excavator of FIG. 1.
Figure 6:
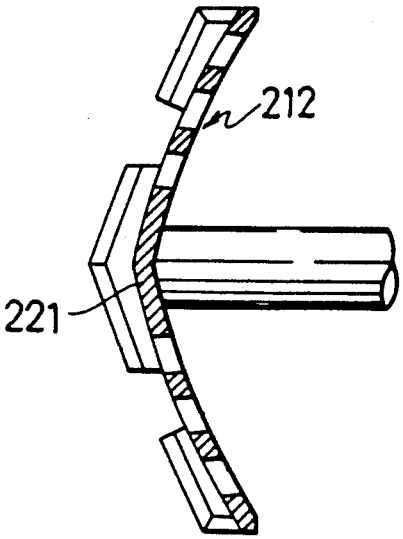
Figure 4:
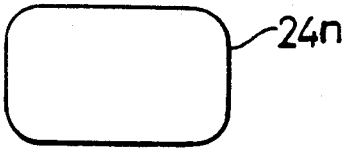

In the present invention, various design modifications can be adopted. For example, the passages 24*a*–24*i* made in the cutter face plate 21 are not limited to be circular as shown, but may be elliptical passages 24*m* as shown in FIG. 3, or rectangular passages 24*n* rounded at corners as shown in FIG. 4. It has been found in this respect that the ratio of the minimum width to the maximum width should preferably be set in a range of 1:1 to 1:1.5. Further, the excavating cutter 112 may have a cutter face plate 121 of a stepped conical shape as shown in FIG. 5 in which the conic angle of the plate 121 varies at an intermediate position. The excavating cutter 212 may also be formed having a cutter face plate 221 of curved conical shape to be generally shaped as in FIG. 6.

Further, while the arrangement for the axial forward and rearward shift of the rotary drive shaft has been referred to as being attained by means of the rolling contact between the cam having the wavy cam surface and the rollers, various other arrangements employing hydraulic jacks of oil or pneumatic pressure for reciprocal motion, crank system or the like also may be utilized.

What is claimed is:

1. An underground excavator comprising:

a generally cylindrical body;

a bulkhead in the forward end of the generally cylindrical body that defines a chamber;

a fixing plate secured inside the generally cylindrical body at a position rearward from the bulkhead with an intermediate space left between the fixing plate and the bulkhead;

a rotary shaft passing rotatably through the bulkhead and fixing plate and having a forward end projected into the chamber and a rearward end extending rearwardly out of the fixing plate;

means for shifting the rotary shaft forward and rearward with respect to the bulkhead, said shifting means comprising:

a support disk coupled to the exposed rearward end of the rotary shaft as spaced from the fixing plate;

a resetting spring disposed between the fixing plate and the support disk for normally providing to the rotary shaft a resetting force acting in rearward direction;

a cam secured to the rotary shaft to be within the intermediate space and having on the rearward side of the cam a wavy cam surface which includes alternately continuing concave and convex portions extending axially from the rotary shaft; and a cam follower secured at a first portion thereof to an inner wall of the cylindrical body in the intermediate space and normally brought at a second portion into rolling contact with the wavy cam surface of the cam so that the rearward biasing force of the resetting spring and rotation of the rotary shaft and cam thereon cooperate to cause the shaft to shift forward and rearward;

a drive power source connected to the fixing plate and coupled to the rotary shaft through a gear secured to the rotary shaft within the intermediate space;

an excavating cutter mounted to the forward end of the rotary shaft and including a cutter face plate of a generally conical shape and provided with a plurality of cutter bits projecting forward from the cutter face plate and extending radially from the cutter face plate, and a plurality of passages through the cutter face plate; and means forming an opening in the chamber of a diameter larger than the passages for discharging excavated material from the chamber through the opening to a position behind the bulkhead and fixing plate.

2. The underground excavator of claim 1 wherein the generally conical shape of the cutter face plate is selected depending upon the geologic nature of the ground through which the excavator is to make a bore such that the cutter face plate is more inclined at its portion adjacent its outer periphery than at the central portion within a selected radial distance from the rotary shaft.

3. The underground excavator of claim 1 wherein the rearward resetting force of the resetting spring acts to keep the cam follower always in rolling contact with the wavy cam surface of the cam.

4. The underground excavator of claim 1 wherein the support disk is so coupled to the rotary shaft as to follow only the forward and rearward shift of the rotary shaft and not to follow the rotation of the shaft.

* * * * *